US006612000B2

(12) United States Patent
Housley

(10) Patent No.: US 6,612,000 B2
(45) Date of Patent: Sep. 2, 2003

(54) BOTTOM HANGER CLOTHES CLIP

(75) Inventor: David R. Housley, Lamma Island (HK)

(73) Assignee: Acotex Far East Limited, Hong Kong (CN)

( * ) Notice: Subject to any disclaimer, the term of this patent is extended or adjusted under 35 U.S.C. 154(b) by 0 days.

(21) Appl. No.: 10/041,131

(22) Filed: Jan. 7, 2002

(65) Prior Publication Data

US 2003/0126725 A1 Jul. 10, 2003

(51) Int. Cl.[7] ..... A41F 1/00; A44B 21/00; A45F 5/02; A47G 25/48

(52) U.S. Cl. ..... 24/510; 24/489; 24/499; 24/500; 24/509; 24/564; 223/91; 223/93; 223/96

(58) Field of Search ..... 24/510, 509, 489, 24/499, 500, 564, 501; 223/91, 90, 93, 96

(56) References Cited

U.S. PATENT DOCUMENTS 648,534 A * 8/1900 Seger ..... 223/91
2,500,032 A * 3/1950 Helberg ..... 24/510
3,946,915 A * 3/1976 Crane ..... 223/96
4,175,306 A * 11/1979 Bigelow et al. ..... 24/510
4,741,074 A * 5/1988 Budano, II et al. ..... 24/510
4,752,978 A 6/1988 Simpson
D298,703 S 11/1988 Arnold
4,839,947 A * 6/1989 Cohen et al. ..... 24/499
4,878,276 A 11/1989 Morrish
5,052,085 A 10/1991 Gau
5,075,935 A 12/1991 Abdi
5,241,728 A 9/1993 Hunter
5,402,558 A 4/1995 Santapa
5,546,640 A * 8/1996 Kronauer et al. ..... 24/510
5,890,634 A 4/1999 Zuckerman
5,934,525 A 8/1999 Blanchard
6,023,818 A 2/2000 Shang
6,023,819 A 2/2000 Wong
6,050,462 A 4/2000 Petrou
6,105,836 A * 8/2000 Batts et al. ..... 223/96
6,119,906 A 9/2000 Bond
6,202,906 B1 3/2001 Zuckerman
6,305,586 B1 10/2001 Wong

* cited by examiner

*Primary Examiner*—Victor Sakran
(74) *Attorney, Agent, or Firm*—Lilling & Lilling P.C.

(57) ABSTRACT

A clothes clip has a biasing spring that imparts a symmetrical force to each of the gripping members of the clothes clip. The two distal ends of the spring press against the fixed jaw of the clip at point equidistant from the central axis, and a central loop of the spring presses against the movable jaw of the clip along its central axis.

17 Claims, 5 Drawing Sheets

20
38
22
28
58
44
52
24
50
46
34
36
48
26
64
66
66
30
40

BOTTOM HANGER CLOTHES CLIP

FIELD OF THE INVENTION

This invention relates to the clothing industry and, in particular, to an improved clothes clip for the bottom of a hanger.

BACKGROUND OF THE INVENTION

For many years, various types of hangers in different shapes and sizes have been used to support all different types of clothing, including coats, jackets, shirts, pants and other articles of clothing. In many instances there will be some type of clothes clip on the bottom portion or rod of the hanger in order to hold skirts, pants and other articles of clothing. Among the various clothes clips that have been used are the ones shown in Morrish (U.S. Pat. No. 4,878,276), Gau (U.S. Pat. No. 5,052,085), Abdi (U.S. Pat. No. 5,075,935), Hunter (U.S. Pat. No. 5,241,278), Santapa (U.S. Pat. No. 5,402,558), Zuckerman (U.S. Pat. No. 5,890,634), Blanchard (U.S. Pat. No. 5,934,525), Wong (U.S. Pat. No. 6,023,819), Petrou (U.S. Pat. No. 6,050,462), Bond (U.S. Pat. No. 6,119,906), Zuckerman (U.S. Pat. No. 6,202,906), and Wong (U.S. Pat. No. 6,305,586).

These clothes clips are important to secure the clothes to the hanger. One of the problems with current clothes clips is that the biasing means loosens and the clip no longer securely holds the clothes, thereby causing them to fall on the floor. For expansive and delicate clothes sets and suits, garments that fall our from the clothes clip can be soiled or damaged or just wrinkled, thereby rendering them difficult to sell. In a home environment, the problem can be exacerbated, as the clothes may be soiled or wrinkled and can not be worm without dry cleaning.

It is common for clothing manufacturers to ship clothing on hangers, including hangers with bottom clothes clips to secure skirts, pants and other articles of clothing. When the clips fail or loosen, the clothes fall out off the hanger during transit. Necessarily this causes the garments to be soiled and/or wrinkled and, in some cases, damaged. Not only is there the extra labor of replacing the garments on the hangers, but there may also be the extra cost of cleaning and pressing the garments to make them saleable.

A typical coil spring hanger clip is shown by Wong (U.S. Pat. No. 6,023,819). As shown the free ends of the coil spring are biased between a pair of jaws. The problem with this clip is that the force of the coil spring is not symmetrically applied to the jaws of the clip. In particular, it may be seen that the free ends of the coil spring press against the inner faces of the respective jaws, but not along the central axis of the jaw face. Instead, each free end of the coil spring is offset some distance from the central axis. Accordingly, when the clip is squeezed and force is exerted against the jaws, the jaws will rotate to some extent due to the fact that the force of the spring is not symmetrically applied to each jaw. Over time, this causes a weakening of the jaws and of the clip. This renders the clip unuseable, and clothes will then start to slip out from the clip and they will not be held securely.

Therefore, there is a need in the industry for a simple, easy to use, inexpensive coil spring clothes clip that will not loosen over time and which will continue to hold clothes securely.

SUMMARY OF THE INVENTION

Therefore, it is an object of this invention to provide a clothes clip for a hanger that will not loosen and the coil spring will maintain uniform and symmetrical force on the clip for the entire useful life of the hanger.

This and other objects of the invention are obtained by a clothes clip with a coil spring that applies symmetrical force to each of the gripping faces of the clip.

The two free ends of the coil spring press against one of the gripping faces at points equidistant from a central axis of the gripping face. Then, a central loop of the spring presses against the other gripping face along its central axis. By this construction, symmetrical force is applied to each gripping face and there is no twisting or rotation. Accordingly, the clip does not loosen over time, and it continues to hold the clothes securely.

DETAILED DESCRIPTION OF THE INVENTION

Figure 1:
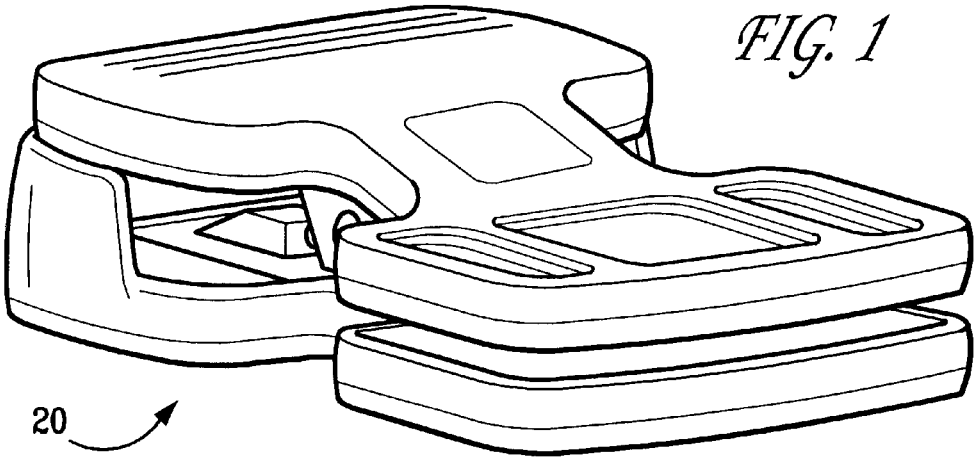
FIG. 1 is a perspective view of the bottom hanger clothes clip.
Figure 2:
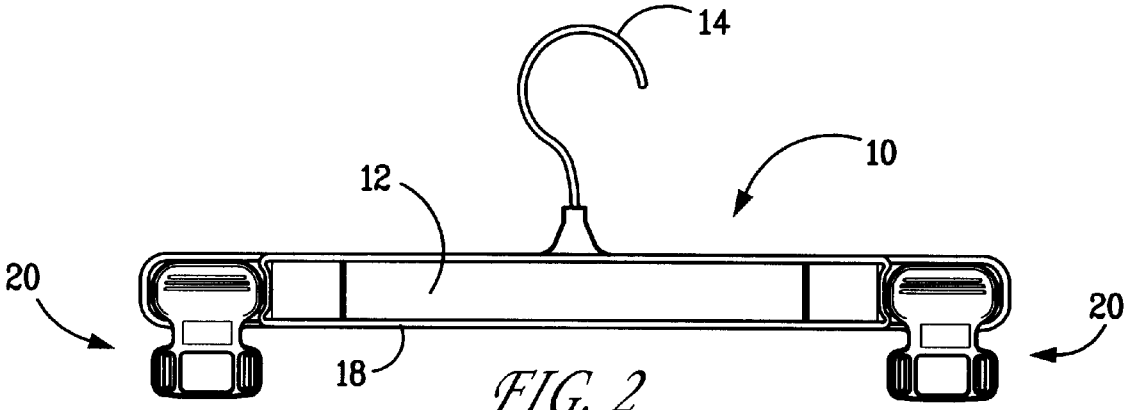
FIG. 2 is a front view of a hanger with the bottom hanger clothes clip of this invention.
Figure 3:
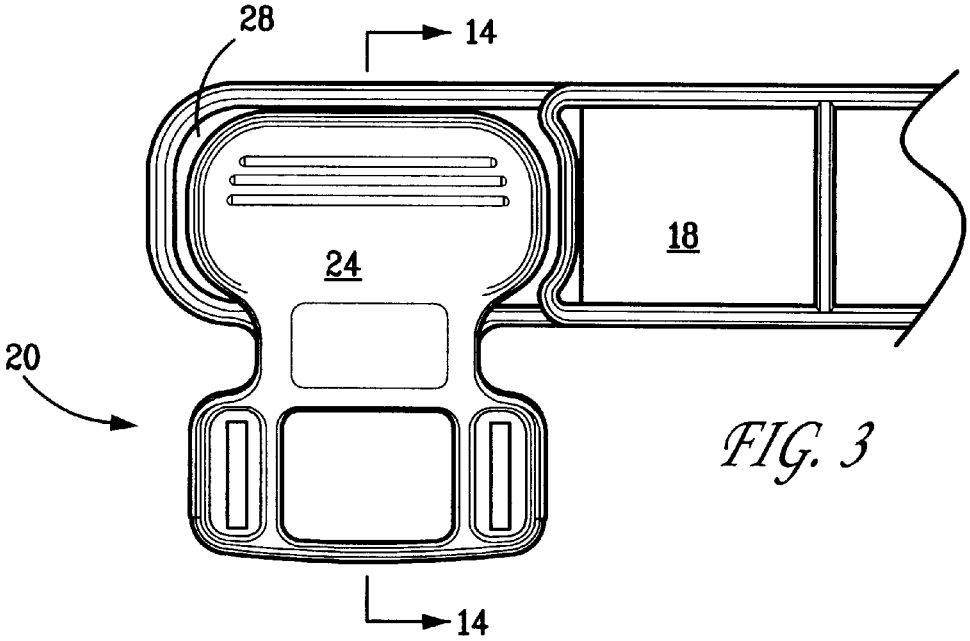
FIG. 3 is an enlarged front view of the bottom hanger clothes clip of this invention.
Figure 4:
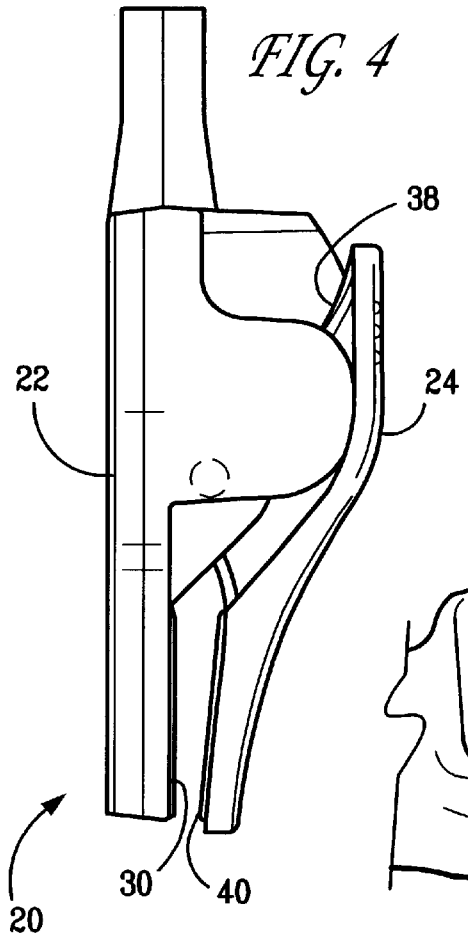
FIG. 4 is a side view of the bottom hanger clothes clip of this invention.
Figure 5:
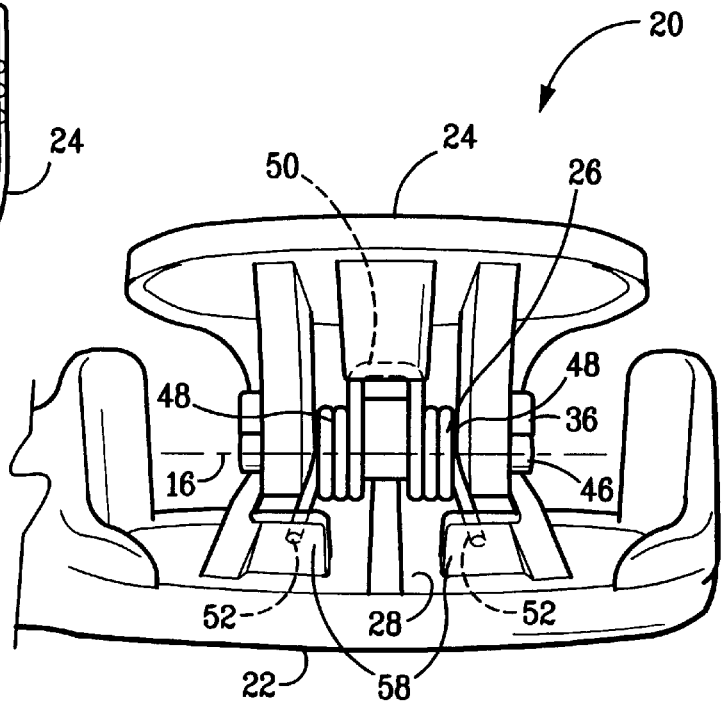
FIG. 5 is a top view of the bottom hanger clothes clip of this invention.
Figure 6:
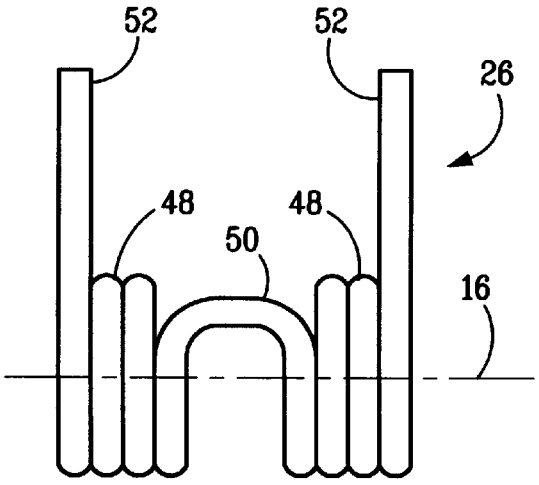
FIG. 6 is a front view of the coil spring of the clothes clip of this invention.
Figure 7:
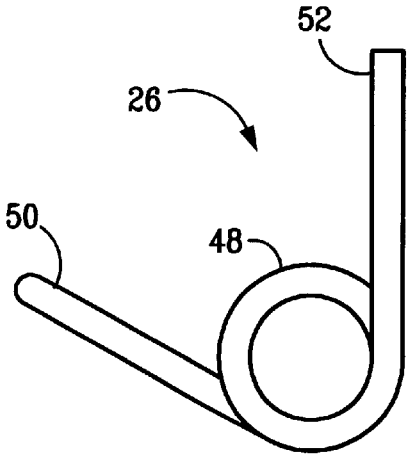
FIG. 7 is a side view of the coil spring of the clothes clip of this invention.
Figure 8:
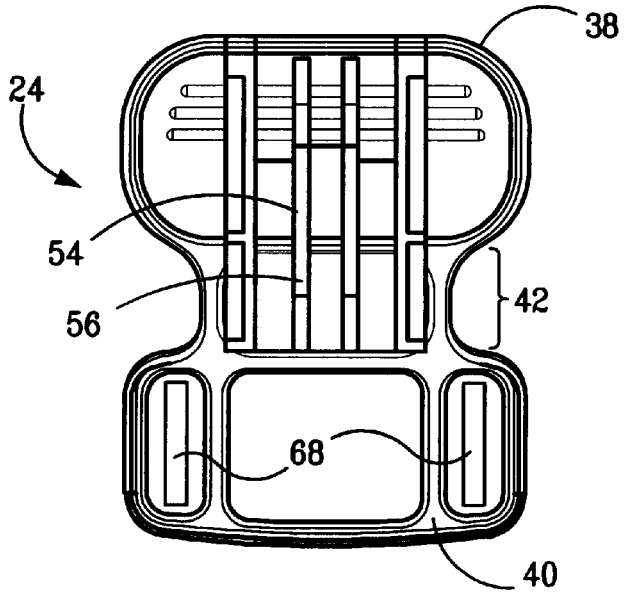
FIG. 8 is a front view of the movable gripping members of the cloths clip.
Figure 9:
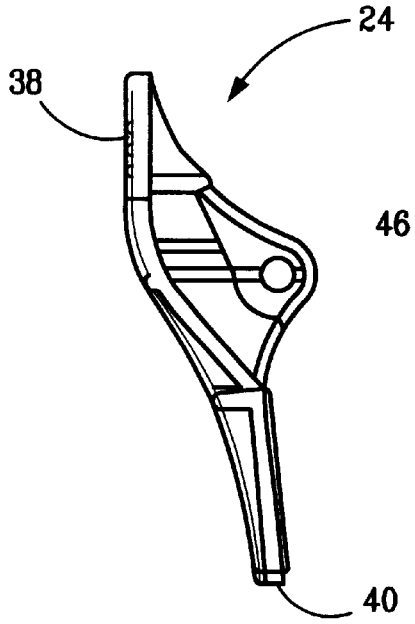
FIG. 9 is a side view of the movable gripping member, shown in FIG. 8.
Figure 10:
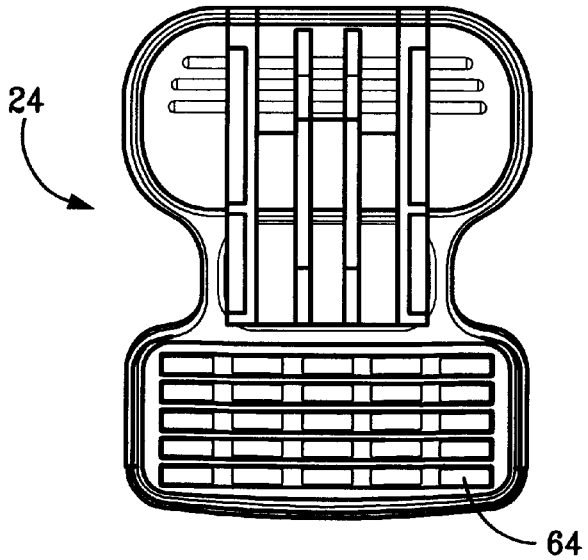
FIG. 10 is a front view of the movable gripping members with a pad on its gripping face.
Figure 11:
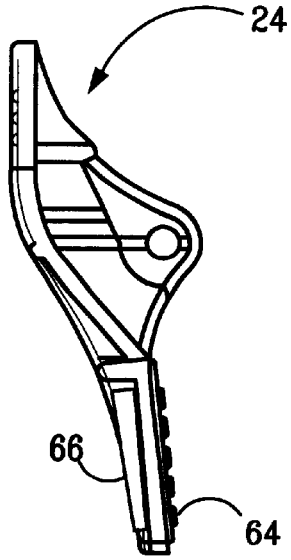
FIG. 11 is a side view of the movable gripping member, shown in FIG. 10.
Figure 12A:
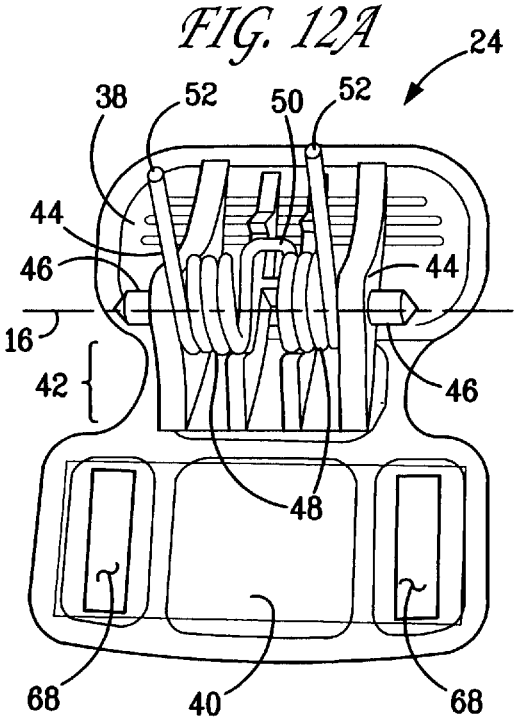
FIG. 12A is a perspective view of the movable gripping member with the spring in position.
Figure 12B:
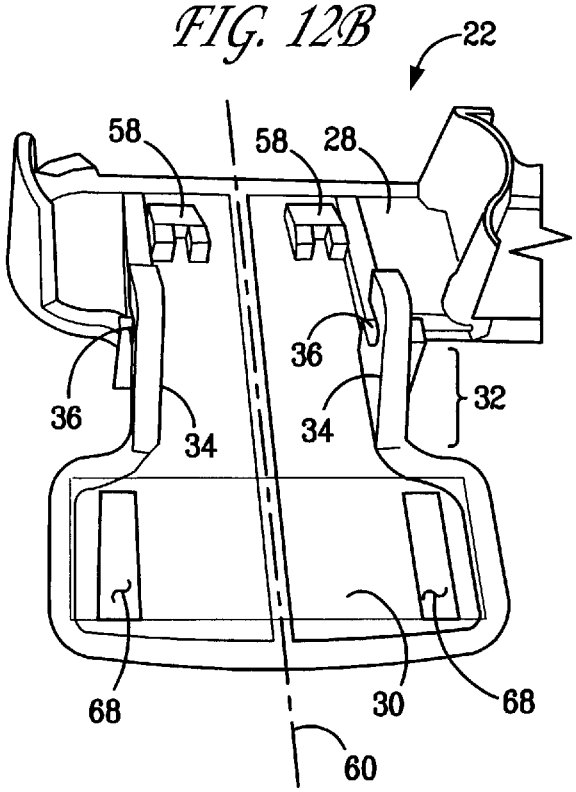
FIG. 12B is a perspective view of the fixed gripping member without the spring in position.
Figure 13A:
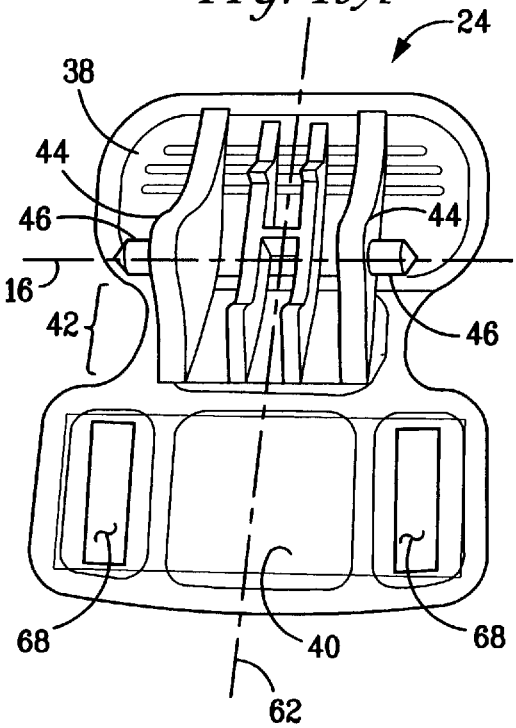
FIG. 13A is a perspective view of the movable gripping member without the spring in position.
Figure 13B:
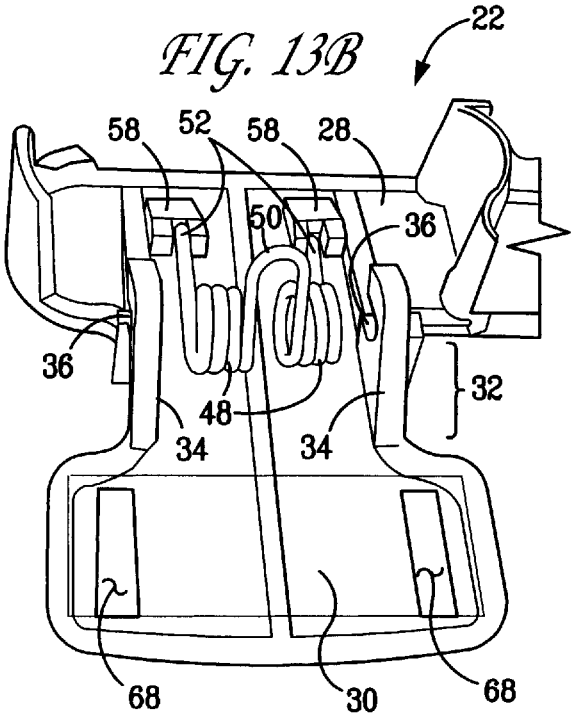
FIG. 13B is a perspective view of the fixed gripping member with the spring in position.
Figure 14:
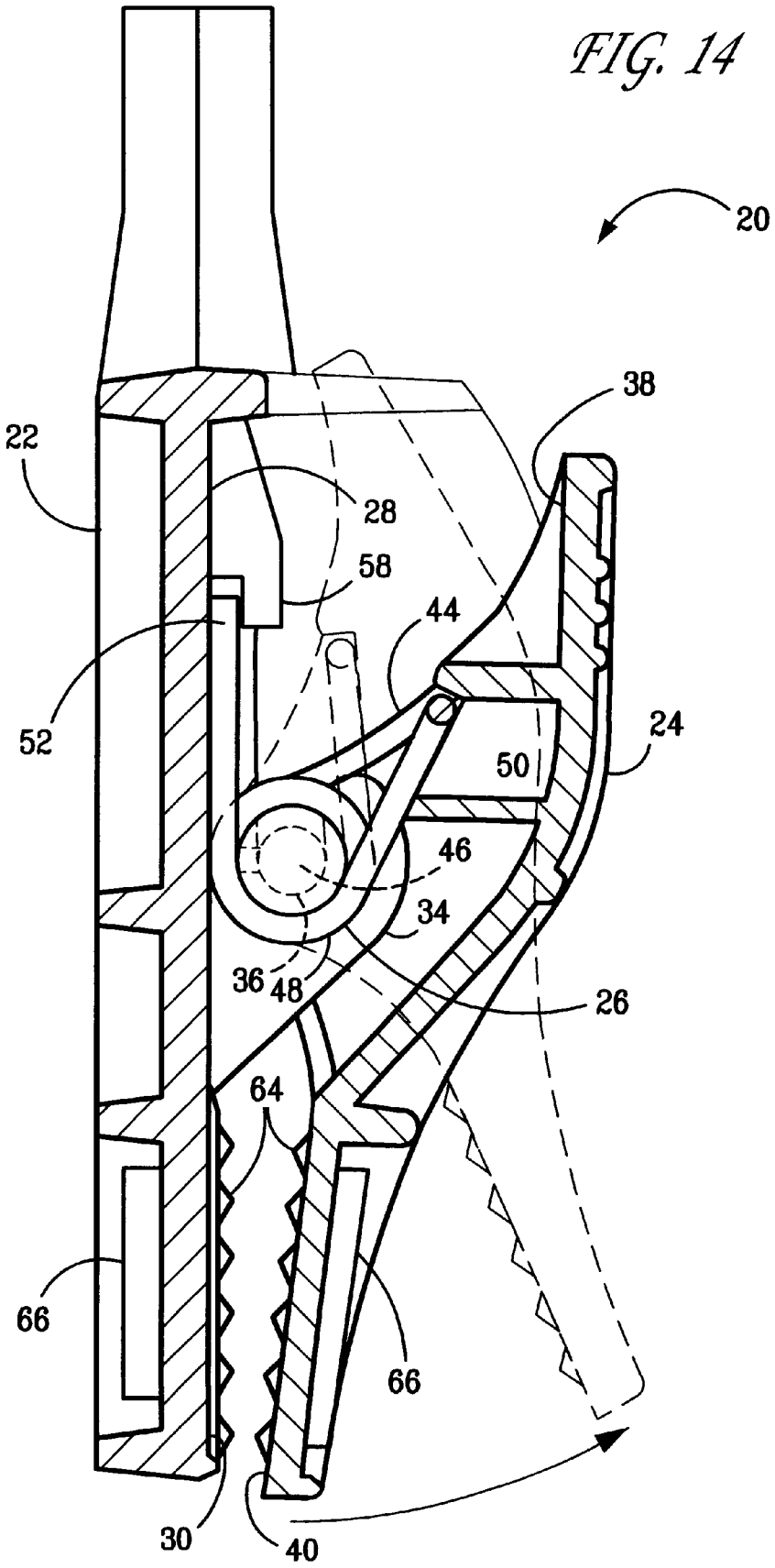
FIG. 14 is a cross-sectional view taken along line 14—14 of FIG 3.

The basic hanger 10 can be of any size, shape and configuration that is standard in the industry. In the preferred embodiment, the hanger may be a one piece, integral molded unit made of a reasonably strong, semi-rigid plastic, such as styrene-butadiene. Such plastics are manufactured by Phillips 66 under the Trademark K-RESIN and by BASF under the trademark SYROLUX. Any other materials that are accepted in the industry for making plastic hangers may be used. Further, the hanger of this invention may work as well if made from wood, metal or a composite material.

The basic hanger 10 includes an unitary body 12. As is known in the industry, the hook may be made of any suitable wire stock or other metal. Plastic may be used for the hook, but it is not as strong or as pliable. If desired, the hanger may have an I-beam type construction.

For use with the herein described invention, the hanger needs to have a bottom flange, beam or rod 18 on which one or more clothes clips 20 may be positioned. This is known in the industry. Usually, a hanger will include two clothes clips offset from the center, but the invention will work without regard to the number of clothes clips. One, three or more clips may be utilized.

Each of the clothes clips is constructed in exactly the same manner, so only one illustrative clothes clip will be described herein.

As is usual with clothes clips, this clothes clip has two gripping members, such as jaws, that pivot with respect to each other in order to hold and release an article of clothing. One gripping member or jaw 22 is stationary or fixed and is made integral with the hanger, and the second gripping member or jaw 24 pivots about the first jaw to create a functioning clothes clip. A biasing means, such as a coil wire spring 26, holds the jaws together in a normal position to securely hold an article of clothing. Pressure on the jaws overcomes the force of the biasing means to open the clip and release the clothing.

In order to better support this clothes clip, it is preferable that the lower flange or beam 18 of the hanger have a flat cross-section. The top or support face 28 of the fixed jaw 22 is made integral with the beam 18, as is known in the trade; and, the opposite end of the jaw defines a gripping face 30, which will engage the clothing. A transition region 32 between the support face 28 and the gripping face 30 includes two parallel supports 34, each defining a seat 36.

The movable jaw 24 has a top or release face 38 and a gripping face 40 at its other end. In a transition region 42 between the two faces, two parallel supports 44 are positioned. Pins 46 extend out from the upper region of the supports.

Each of the jaws is made as a single piece of molded plastic.

To pivotally connect the two jaws, they are overlaid—one over the other, so that the pins 46 on the supports 44 of the movable jaw 24 rest in the seats 36 on the supports 34 of the fixed jaw 22. Thus, the jaws pivot about the axis of the pins 46, as is known in the trade.

The wire coil spring 26 used as the biasing means may be any gauge wire that is commonly used for springs in clothes clips. The particular gauge will depend on the force that needs to be exerted by the spring.

As shown, the spring 26 is disposed so that it has two coils 48 oriented along the same axis 16 as the pins 46 about which the jaws pivot with respect to each other. Between the two coils, a loop 50 of the spring exerts a uniform and symmetrical force on the movable jaw 24. The two distal ends 52 of the spring press on the fixed jaw 22 and exert a symmetrical force on it. By means of the spring, the clip is held in a normally closed position.

To between support the spring and to prevent it from moving or slipping, a seat 54 may be built on the transition area 42 of the movable jaw 24. Concave recesses 56 define seats on which the coils 48 and/or a portion of the loop 50 may be supported.

On the support face 28 of the fixed jaw 22, abutments 58 may be positioned. The distal ends 52 of the spring 26 fit into holes in the abutments and are held securely. These abutments are positioned equidistant from the central axis 60 of the support face 28 and of the fixed jaw 22. Because the distal ends of the spring are equidistant from the central axis, they necessarily apply a symmetrical force on the fixed jaw. This is not possible with the wire springs of the prior art clothes clips.

The top end and sides of the loop 50 of the spring 26 press on the release face 38 of the movable jaw 24 symmetrically with respect to its central axis 62. Because the loop presses along the central axis, symmetrical force is applied to the movable jaw, which was not accomplished by the wire springs of the prior art clothes clips.

It may be appreciated that the distal ends of the spring may press against the movable jaw, and the loop of the spring may press against the fixed jaw. It makes no difference which way the spring is oriented. The key point is that there must be symmetrical force on each jaw.

In operation, the clothes clip is normally closed. Pressure of a user's fingers on the release face 38 of the movable jaw 24 overcomes the force of the spring and moves the top or release face near the top or support face 28 of the fixed jaw 22. Due to the pivot arrangement of the two jaws, this action causes the gripping faces 30 and 40 of the two jaws to separate. The user then places an article of clothing between the gripping faces. When the release face is released by the user, the spring moves the jaws back into position, and the clothing is held securely between the gripping faces. To release the clothing, the user again applies pressure on the release face of the movable jaw as heretofore, and the clothing can be removed from between the gripping faces.

To improve the gripping action of the gripping faces, raised teeth or dimples may be applied to the surface. For more delicate clothes, pads 64 may be placed on the gripping surfaces To affix the pads 64 one could utilize direct molding of the pad and the gripping surface, or just use an adhesive. Generally, the pads may be made of a tactile material, preferably with good anti-slip qualities.

Another way to affix the pads is to provide projections 66 on the pads which fit into recesses or openings 68 on the gripping surfaces. One version uses projections with arrow shaped heads that extend into slots. Cylindrical and rectangular shapes may also be used.

Hangers with these clothing clips may be made in standard 8", 10", 12" or 14" widths. Softer or harder springs may be used, depending on the thickness or bulkiness of the clothes to be held by the hanger. For heavy weight trousers or skirts, a heavier gauge spring may be desirable. For light summer clothes and bathing suits, a much lighter gauge spring would be used, so as to not damage the more delicate clothing.

The invention is described in detail with reference to a particular embodiment, but it should be understood that various other modifications can be effected and still be within the spirit and scope of the invention.

I claim:

1. A clothes clip for securing clothes to a garment hanger, wherein the clothes clip consists of a first gripping member attached to a depending edge of said garment hanger and a second gripping member pivotally mounted on said first gripping member, each of said gripping members having a gripping face and a top end, and wherein the improvement comprises a symmetrical wire spring exerting symmetrical force on said gripping members about a central axis of said first and second gripping member, said symmetrical wire spring having two coils and a central loop, distal ends of said symmetrical spring bearing against said top end of said first gripping member, said central loop of said symmetrical spring bearing against said top end of said second gripping member, and said coils of said symmetrical spring being positioned along a pivot axis of said first and second gripping members, wherein said force of said symmetrical spring maintains the gripping faces together to hold clothes securely, and wherein pressure on said top ends of said griping members momentarily overcomes said force of said symmetrical spring to separate said gripping faces for removal of said clothes.

2. A clothes clip according to claim 1, wherein said distal ends of said symmetrical wire spring bear against said top end of said first gripping member at equidistant points on either side of said central axis of said first gripping member and said central loop of said symmetrical springs bears against said top end of said second gripping member along said central axis of said second gripping member.

3. A clothes clip according to claim 2, wherein said first gripping member further includes a transition region between the top face and the gripping face, and two parallel supports each defining a seat, located on said transition region; and said second gripping member further includes a transition region between the top face and the gripping face, two parallel supports positioned in said transition region, and pins extending out from an upper region of the supports, whereby the pins on the supports of the second gripping member rest in the seats on the supports of the first gripping member.

4. A clothes clip according to claim 3, further comprising a seat on the transition area of the second gripping member on which the coils and/or a portion of the loop of the spring are supported.

5. A clothes clip according to claim 2, further comprising abutments positioned on the top face of the first gripping member and said distal ends of the spring fit into holes in the abutments and are held securely.

6. A clothes clip according to claim 1, wherein teeth are provided on inner surfaces of said gripping faces.

7. A clothes clip according to claim 1, wherein pads are mounted on inner surfaces of said gripping faces.

8. A clothes clip according to claim 7, wherein said pads are made of a tactile material.

9. A clothes clip according to claim 7, wherein said gripping faces have slots on said inner surfaces and said pads have projections that are secured within said slots to hold said pads securely on said gripping faces.

10. A clothes clip according to claim 1, wherein said first gripping member further includes a transition region between the top face and the gripping face, and two parallel supports, each defining a seat, located in said transition region; and said second gripping member further includes a transition region between the top face and the gripping face, two parallel supports positioned in said transition region, and pins extending out from an upper region of the supports, whereby the pins on the supports of the second gripping member rest in the seats on the supports of the first gripping member.

11. A clothes clip for securing clothes to a garment hanger, comprising: a first gripping member attached to a depending edge of said garment hanger and having a gripping face and a top end; a second gripping member pivotally mounted on said first gripping member and having a gripping face and a top end; and, a symmetrical wire spring exerting symmetrical force on said first and second gripping members, said symmetrical spring having two coils and a central loop, distal ends of said symmetrical spring bearing against said top end of said first gripping member, said central loop of said symmetrical spring bearing against said top end of said second gripping member, and said coils of said symmetrical spring being positioned along a pivot axis of said first and second gripping members, wherein said force of said symmetrical spring maintains the gripping faces together to hold clothes securely, and wherein pressure on said top ends of said griping members momentarily overcomes said force of said symmetrical spring to separate said gripping faces for removal of said clothes

12. A clothes gripping according to claim 11, wherein said distal ends of said symmetrical spring bear against said top end of said first gripping member at equidistant points on either side of a central axis of said first gripping member and said central loop of said symmetrical spring bears against said top end of said second gripping member along a central axis of said second gripping member.

13. A clothes clip according to claim 12, wherein said first gripping member further includes a transition region between the top face and the gripping face, and two parallel supports, each defining a seat, located on said transition region; and said second gripping member further includes a transition region between the top face and the gripping faces, two parallel supports positioned in said transition region, and pins extending out from an upper region of the supports, whereby the pins on the supports of the second gripping member rest in the seats on the supports of the first gripping member.

14. A clothes gripping according to claim 11, wherein teeth are provided on inner surfaces of said gripping faces.

15. A clothes gripping according to claim 11, wherein pads are mounted on inner surfaces of said gripping faces.

16. A clothes gripping according to claim 15, wherein said pads are made of a tactile material.

17. A clothes gripping according to claim 15, wherein said gripping faces have slots on said inner surfaces and said pads have projections that are secured within said slots to hold said pads securely on said gripping faces.

* * * * *